US005609054A

United States Patent [19]

Ogawa et al.

[11] Patent Number: 5,609,054

[45] Date of Patent: Mar. 11, 1997

[54] ROLLING MILL FOR FLAT PRODUCTS

[75] Inventors: Shigeru Ogawa; Toshiyuki Shiraishi, both of Futtsu, Japan

[73] Assignee: Nippon Steel Corporation, Tokyo, Japan

[21] Appl. No.: 50,102

[22] PCT Filed: Aug. 27, 1992

[86] PCT No.: PCT/JP92/01087

§ 371 Date: May 7, 1993

§ 102(e) Date: May 7, 1993

[87] PCT Pub. No.: WO93/04795

PCT Pub. Date: Mar. 18, 1993

[30] Foreign Application Priority Data

| | | | |
|---|---|---|---|
| Sep. 10, 1991 | [JP] | Japan | 3-230450 |
| Nov. 5, 1991 | [JP] | Japan | 3-288553 |
| Dec. 2, 1991 | [JP] | Japan | 3-343926 |

[51] Int. Cl.[6] ..... B21B 31/32; B21B 37/08

[52] U.S. Cl. ..... 72/14.1; 72/14.5; 72/241.6; 72/245; 72/247

[58] Field of Search ..... 72/241.2, 241.4, 72/241.6, 242.4, 245, 247, 14.1, 14.4, 14.5

[56] References Cited

U.S. PATENT DOCUMENTS

| | | | |
|---|---|---|---|
| 1,614,425 | 1/1927 | Coe | 72/241.4 |
| 2,792,730 | 5/1957 | Cozzo | 72/241.6 |
| 3,429,166 | 2/1969 | Baker et al. | 72/242.2 |
| 3,839,944 | 10/1974 | Swift | 72/21 |
| 3,861,183 | 1/1975 | Fukui et al. | 72/245 |
| 4,676,085 | 6/1987 | Ellis | 72/245 |
| 4,938,045 | 7/1990 | Rosenstock et al. | 72/19 |

FOREIGN PATENT DOCUMENTS

| | | | |
|---|---|---|---|
| 2547490 | 4/1977 | European Pat. Off. . | |
| 359459 | 11/1980 | European Pat. Off. . | |
| 0035009 | 9/1981 | European Pat. Off. . | |
| 8403103 | 7/1984 | European Pat. Off. . | |
| 3537153 | 5/1987 | European Pat. Off. . | |
| 0416880 | 3/1991 | European Pat. Off. | 72/243.4 |
| 0148405 | 11/1981 | Japan | 72/241.2 |
| 58-55111 | 4/1983 | Japan . | |
| 0210307 | 10/1985 | Japan | 72/243.4 |
| 62-166010 | 7/1987 | Japan . | |
| 0132710 | 6/1988 | Japan | 72/241.4 |
| 0205805 | 8/1989 | Japan | 72/241.4 |
| 4-66205 | 3/1992 | Japan . | |

OTHER PUBLICATIONS

Patent Abstracts of Japan, vol. 9, No. 319 (M–439), Dec. 14, 1985 & JP–A–60 154 804 (Ishikawajima Harima Jukogyo), Aug. 14, 1985 abstact.

Patent Abstacts of Japan, vol. 9, No. 290 (M–430), Nov. 16, 1985 & JP–A–60 130 409 (Hitachi Seisakisho), Jul. 11, 1985 abstact.

Patent Abstacts of Japan, vol. 10, No. 163 (M–487), Jun. 11, 1986 & JP–A–61 017 311 (Mitsubishi Jukogyp), Jan. 25, 1986 abstract .

*Primary Examiner*—Lowell A. Larson
*Assistant Examiner*—Thomas C. Schoeffler
*Attorney, Agent, or Firm*—Kenyon & Kenyon

[57] ABSTRACT

A rolling mill for flat products characterized by a roll assembly including a pair of work-rolls confronted reciprocally, and support-rolls divided by not less than three partitions in a roll axiswise direction which are provided, independently, with load detector equipment; crown and flatness of the products can be estimated precisely and regulated without delay using the rolling mill.

10 Claims, 11 Drawing Sheets

ROLLING MILL FOR FLAT PRODUCTS

TECHNICAL FIELD

The invention relates to a rolling mill for reducing the thickness of flat products including foil, strip, sheet and plate, that improves thickness and flatness distribution characteristics during production. Although the invention concerns all of the flat products, in the following description the rolled material is mostly referred to as "a plate" for simplicity.

BACKGROUND ART

Previously, most rolling mills for flat products have been two high and four high rolling mills, as shown in FIG. 1 and FIG. 2. However technical problems, such as control of thickness in a widthwise direction (plate crown) and flatness uniformity (plate shape), have occurred in these mills. As a means to resolve these technical problems, rolling mills with various roll equipment of bending, shifting and crossing and the like have been developed.

Each of these mills is equipped with an effective controlling device and technology that has already been adopted in various rolling mills, but even if these mills are used, uniform distribution of the rolling load between a rolled material and work-roll cannot been obtained, thereby making it difficult to estimate precisely the crown and shape of the product after rolling.

It is possible to estimate plate crown and plate shape based on such data as rolling load, plate width, plate thickness, the crown and shape before rolling which may be measured or estimated, and the operating conditions for crown and shape control device of the rolling mill.

In this case, however, the accuracy of estimation is limited, so that recent requirements for extreme precision must depend on feedback regulations with a thickness profile meter and a plate shape meter set behind a rolling stand.

The problem with the feedback regulation is the loss of time, which requires more time for rolled material to approach a measuring device from an outlet. Therefore it is difficult to increase a regulation gain, and it is impossible to correspond with high frequency disturbances. Furthermore, generally speaking, the capability of the regulating device for the plate crown and shape is limited within parabolic or quartic distribution with respect to an axis of a plate widthwise direction.

As regards the above mentioned method, a shape regulation method using an eccentric ring in a divided support-roll is adapted in a cluster rolling mill (generally called As- U mechanism), and is capable of regulating a complicated pattern in a widthwise direction. However, even if a profile of the divided support-roll can be obtained in a rolling mill with the As- U mechanism, it is difficult to detect a rolling load distribution and attain a precise work roll bend and roll flattening, which affects the plate profile.

Further, in such a cluster rolling mill, it is possible to devise a mechanism for a rolling mill that detects a rolling load, but even in this case, it is impossible to measure the distribution of the rolling load in a widthwise direction so that the same problems as in the above case will occur.

In Japanese Unexamined Patent Publication No. 57-68208, it is proposed that a work-roll is supported by a support beam through a liquid, and the liquid portion is divided by plural chambers in an axiswise direction. Owing to an increase in the number of divided chambers, it becomes possible to regulate a work-roll bend flexibly, and it is possible to estimate load distribution operating between a work-roll and a support beam through a liquid pressure and load area of each chamber, thereby making it possible to estimate, approximately, load distribution between a rolled material and a work-roll.

However, a problem involving capacity limitation and sealing technique occurs in that excessive impact loads, or compressive stress increases through chambers or the like are not tolerated and a large amount of bending of a work-roll cannot be realized because it induces leakage of the liquid through the sealing device.

A large amount of bending of a work-roll is needed in the following situation, which inevitably arises in a usual rolling operation.

1 to compensate a profile change of work-roll by abrasion and heat expansion, 2 to correct a crown ratio of plate crown/plate thickness during rolling that is different from a crown ratio intended originally, 3 to produce a plate that has a non-uniform thickness distribution prescribed in a widthwise direction.

No prior art has disclosed a rolling mill that, owing to control of a plate crown and shape, can freely regulate a work-roll bend, according to prompt estimation of a plate crown and plate shape based on rolling information obtained by itself.

An object of the invention is to provide a rolling mill for flat products that can freely regulate a plate crown and shape by bending a work-roll according to prompt estimation of a plate crown and shape based on-rolling information obtained by itself.

DISCLOSURE OF INVENTION

In order to perform the above object, in a rolling mill for flat products the invention is characterized by a roll assembly having a structure comprising a work-roll for rolling and support-rolls that can rotate on the periphery of the work-roll, and, specifically, the roll assembly of either the upper or lower side is characterized by a work-roll structure supported by the support-rolls divided by not less than three partitions in a roll axiswise direction, which are provided independently, with load detector equipment. Moreover, as another variation, the rolling mill of the invention is characterized by both upper and lower sides having a divided support-rolls, each with load detector equipment, a rolling mechanism and a roll position detector mechanism.

BEST MODE FOR CARRYING OUT THE INVENTION

The best mode for carrying out the invention will be described in detail below.

Figure 1:
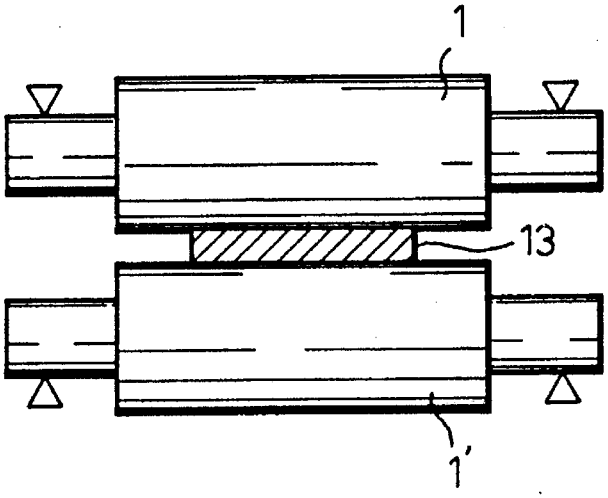
FIG. 1 PRIOR ART
FIG. 1 is a view illustrating a two high rolling mill in a prior art.
Figure 2:
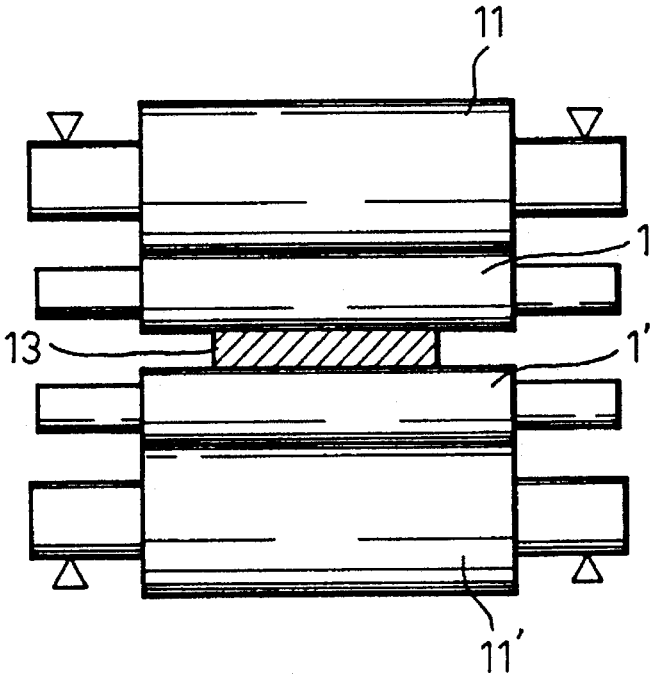
FIG. 2 PRIOR ART
FIG. 2 is a view illustrating a four high rolling mill in a prior art.
Figure 3:
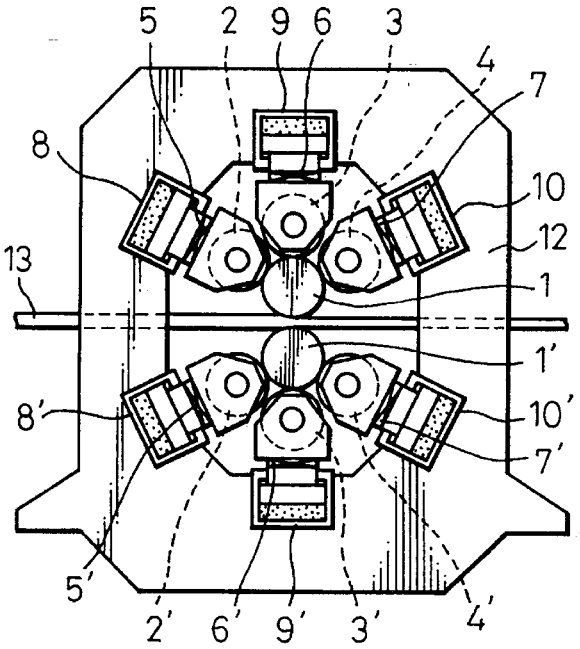
FIG. 3 is a side view illustrating an example of the invention.
Figures 4A, 4B, 4C, 4D:
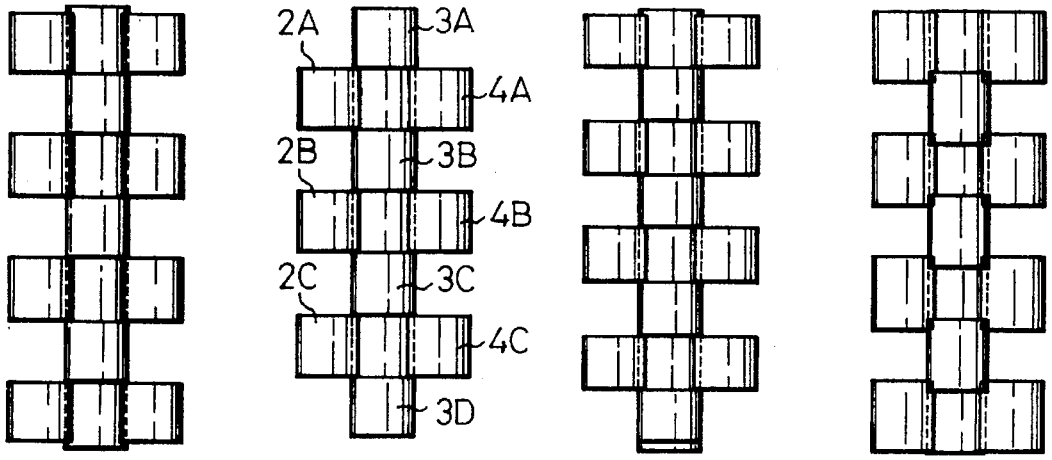
FIG. 4 is a plan view illustrating an example of a placement of a divided support-roll of the invention in an axiswise direction.

In FIG. 3 and FIG. 4, an example of the invention is shown. In the FIGS. a roll assembly of either the upper or lower side comprises a mechanism of a work-roll supported by support-rolls divided by not less than three partitions in an axiswise direction, which are provided, independently, with load detector equipment.

In order to provide independent load detectors, independent support structure is needed for each divided support-roll. To secure the space for the support structure, in FIG. 3 and FIG. 4 one of the divided support-rolls is located just over the work-roll, another is located on the upper right of the work-roll, and the other is on the upper left of the work-roll so that the divided support-roll support the work-roll alternately aligned in an axiswise direction.

FIG. 4 is a top plan view of the rolling mill that shows four kinds of roll arrangements. FIG. 4(*a*) and (*b*) are examples of the roll arrangement of seven partitions of the divided support-roll system aligned in an axiswise direction, and FIG. 4(*c*) is one of eight partitions of the divided support-roll system. The number of partitions of the divided support-roll system may be odd or even, and with respect to the regulation of a symmetrical thickness profile on the right and left side, odd numbers reduce performance costs. FIG. 4(*d*) shows seven divided support-rolls in an axiswise direction, in which each divided roll drum slightly overlaps each other.

According to a mentioned mechanism, the load of the work-roll operating from each divided support-roll can be measured. Therefore the load distribution data operating between a rolled material and a work-roll can be estimated immediately. However, when the number of partitions of a divided support-roll is two or less, it is not possible to regulate a plate crown and shape. Also it is possible to regulate a quadratic component of a plate crown and shape distribution in the widthwise direction if it is divided by more than three. Accordingly, in the rolling mill for a material having various widths, it is preferable to divide by many partitions of the divided support-roll system.

Moreover, a method by which a load operating between a material and a work-roll can be estimated by a load operating between a work-roll and divided support-rolls will be described in detail below.

Figure 5:
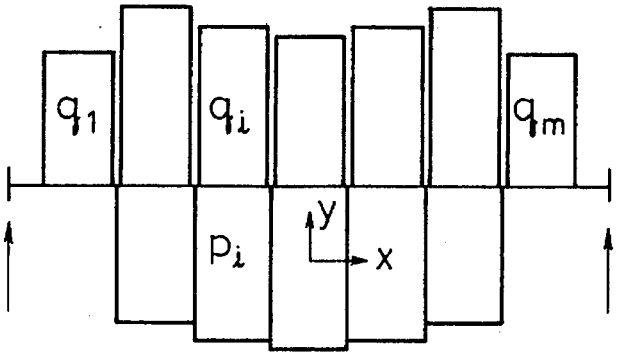
FIG. 5 is a schematic diagram illustrating a distribution of load to a work-roll in a axiswise direction of the invention.

In FIG. 5, a load operating on a work-roll in an upper roll assembly is shown schematically. When a load operating on the i-th divided support-roll is denoted by $q_i$ and each load operating between a rolled material and a work-roll is $P_i$ (lower case), a deformation matrix for deflection of the work-roll axis is $K^W_{ij}$, a deformation matrix of the divided support-roll system is $K^B_{ij}$, a work-roll profile expressed in the form of a roll crown is $C^W_i$, a profile of the divided support-roll system is $C^B_i$, and deflection of the work-roll axis is $y^W_i$, the following equation can be obtained from the compatibility condition between the divided support-roll system and the work-roll;

$$y^W_i = K^B_{ij} q_j + C^B_i + C^W_i \tag{1}$$

Besides, in the mathematical equation of the description, the indices in the equation accord with Einstein's summation rule in which the term with repeated indices is added together within the range of the indices Further, $K^B_{ij}$ is a coefficient matrix expressing the influence of a unit load operating on to the j-th divided support-roll on the deformation of the i-th support-roll. Moreover, a deformation matrix indicates the deformation containing deformation of roll housing and flattening of both rolls generated by contact force between the rolls, and all of $K^B_{ij}$, $K^W_{ij}$, $y^W_i$ are extracted with reference to relative displacements from the mill center.

A work-roll deflection can also be given by using a deformation matrix $K^W_{ij}$ and a distribution of rolling load $P_i$ (lower case letter) operated between a rolled material and a work-roll as follows;

$$y^W_i = K^W_{ij}(p_j - q_j) \tag{2}$$

From eq.(1) and (2) deleting $y^W_i$, a distribution of a rolling load $P_i$ is calculated as follows;

$$p_i = q_i + [K^W]^{-1}_{ij}(K^B_{jk} q_k + C^B_j + C^W_j) \tag{3}$$

In eq. (3) $[K^W]^{-1}_{ij}$ is a inverse matrix element of $K^W_{ij}$ and can be calculated with $K^B_{ij}$ in advance. Further as $C^B_j$ and $C^W_j$ are measurable or can be estimated with on-line models, a distribution of rolling load $P_i$ between a rolled material and a work-roll can be calculated immediately from eq. (3) if the data of $q_k$ can be obtained in a rolling mill of the invention.

In this way, by use of the rolling mill in the invention, a distribution of the rolling load $P_i$ operated between a rolled material and a work-roll can be estimated from the measured data of the load operated between a work-roll and divided support-roll system.

The estimation of a rolling load distribution based on the measured data is fundamentally different from a prior art in that it estimates the rolling load distribution from estimation of the inlet and outlet plate thickness distributions. Therefore, it has higher degree of estimating precision which has not been available in a prior art.

Accordingly, in the case of a rolled material having a uniform distribution of deformation resistance in widthwise direction, it may be regulated so as to be uniformly distributed using calculation of eq.(3), so that rolling condition, such as good shape or uniform elongation strain in a widthwise direction, are performed.

Furthermore, in the case of hot rolling with a non-uniform temperature distribution in a widthwise direction, deformation resistance lacks uniformity in a widthwise direction, however in this case, if temperature distribution in a widthwise direction can be measured, a distribution of deformation resistance can be estimated. By using the estimated data an intended distribution value for a rolling load can be obtained so that a product having good shape can be obtained.

When a rolling mill of the invention is used, even if it does not have a specific profile meter, it can be regulated precisely.

Further, if a rolling load distribution can be obtained, plate thickness distribution, that is plate crown, can be estimated precisely using the following procedures. First, a surface profile $y^{mT}_i$ on the upper side of a plate is calculated by using work-roll flattening matrix $K^{ij}$;

$$y^{mT}_i = y^W_i + K^f_{ij} P_j + C^W_j \quad (4)$$

$P_j$: lower case letter

As shown in FIG. 3, in the case of a symmetric upper and lower side structure, subjecting the calculation of lower roll assembly by the same procedure of the upper, a rolling load distribution $P_i$ and a surface profile of a lower work-roll on the side of rolled material $y^{mB}_i$ are calculated, and then a thickness distribution can be estimated as well.

As distributions of rolling load that are calculated from the upper and lower roll assembly should coincide with each other, the data could be used for studying the current distribution of the work-roll profile.

Figure 6:
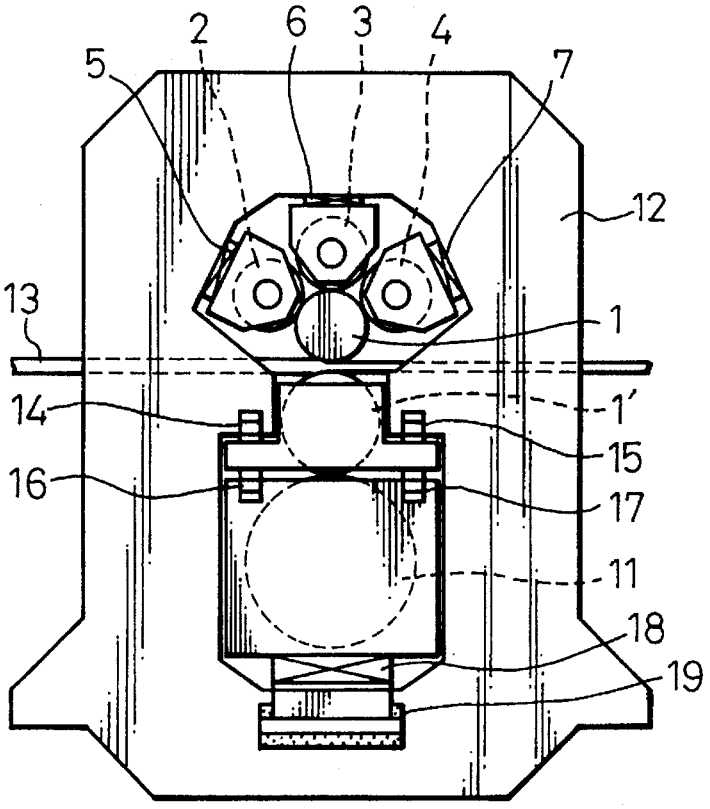
FIG. 6 is a side view illustrating another example of the invention.

Moreover, as shown in FIG. 6, in the case of the other type of roll assembly, a surface profile $y^{mB}_i$ of a work-roll in the other roll assembly may be calculated by using the rolling load distribution obtained from eq. (3).

This can be calculated by the following equation, when a deformation matrix of a work-roll considering support-roll deformation is $K^{BW}_i$;

$$y^{mB}_i = (K^{BW}_{ij} + K^f_{ij}) P_j + C^W_j \quad (5)$$

j: lower case letter wherein, each term of eq. (5) relates to a lower roll assembly, and can be calculated or estimated beforehand. If surface profiles $y^{mT}_i$, $Y^{mB}_i$ are calculated, a distribution hi of plate thickness in a widthwise direction after rolling can be calculated by the following equation;

$$h_i = h_0 + y^{mT}_i - y^{mB}_i \quad (6)$$

wherein, $h_0$ is the thickness in the center of the rolled material.

As described above, by using the invention, a distribution of plate thickness or plate crown in a widthwise direction after rolling can be estimated precisely, and then regulated without a specific detector.

Moreover, as a calculation for the above mentioned estimation of a plate crown and shape can be performed in one hundredth of a second by a process computer, it is possible to regulate precisely a plate crown and shape without delay.

Figure 7:
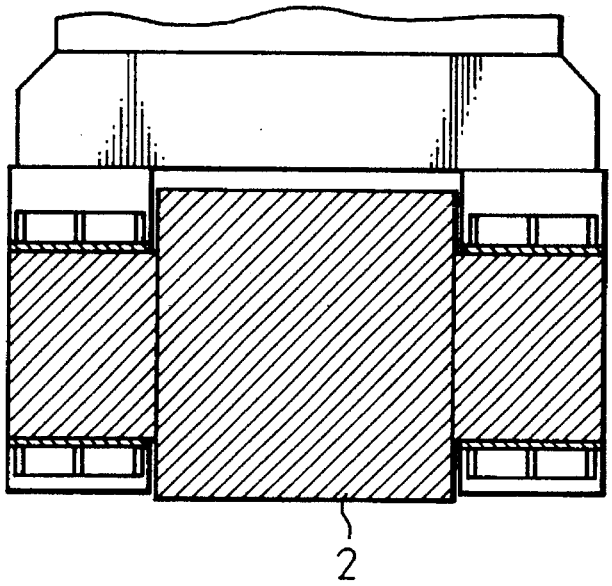
FIG. 7 is a schematic diagram illustrating a bearing mechanism of a divided support-roll of the invention.
Figure 8:
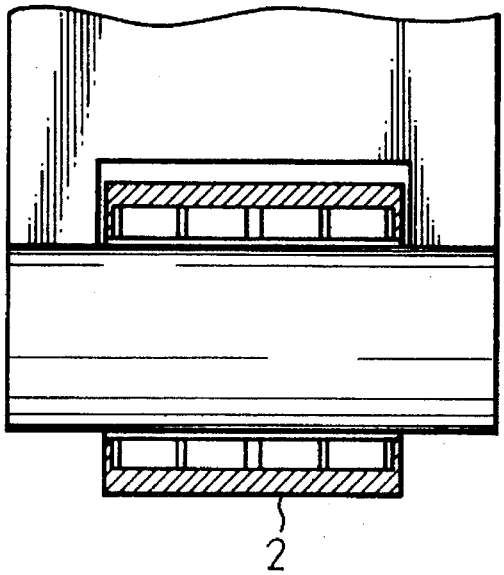
FIG. 8 is a schematic diagram of an example arrangement of a bearing mechanism in a drum portion of a divided support-roll of the invention.

As in the invention bearing device of a divided support-roll system comprises a roller follower type having a bearing in a drum, it is advantageous that a plant design should not require a large roll chock with a bearing on both sides of each support-roll, so that it can tolerate a large rolling load as heavy-duty rolling mill. In FIGS. 7 and 8, one example of the bearing device is shown schematically. FIG. 7 is a type that has a bearing outside the roll drum, and FIG. 8 is a roller follower type in a roll drum. In FIGS. 7 and 8, a rotating portion is shown by hatching.

As shown in FIG. 7, since the diameter of a bearing is restricted by the diameter of a roll, the width of a bearing is increased when bearing a large load. As a large space is necessary outside a roll drum, as in FIG. 4, and then it may be impossible to arrange plural divided support-rolls such that they support the work-roll alternately and throughly in the axiswise direction.

Comparatively as shown in FIG. 8 in the case of arranging a bearing in a roll drum, a large space is unnecessary because there is not a rotating device outside a roll drum. In this case even for an enormous load, it is possible to provide plural divided support-rolls such that they support the work-roll alternately and throughly in the axiswise direction as shown in FIG. 4.

Moreover, the rolling mill of the invention is characterized in both roll assemblies in the upper and lower side having a divided support-roll system that is divided by not less than three partitions in a roll-axiswise direction. And for at least one of either an upper or lower roll assembly, each divided support-roll is provided, independently, with load detector equipment, a loading mechanism and a roll position detector. Owing to an independent loading mechanism and roll position detector it is possible to regulate freely $C^B_i$ in eq.(1) and to regulate a complex shape and crown disturbance in a widthwise direction.

In this case it is not necessary for a detector mechanism of rolling load and roll position, and a loading mechanism to be provided in a roll assembly providing a load detector, for example, an upper roll assembly having only a load detector may be combined with a lower roll assembly having a loading mechanism and a roll position detector without a load detector, and, of course, it is preferable that in respect of the regulation of shape and crown, a load detector, a loading mechanism and a roll position detector are provided both in upper and lower roll assemblies.

Moreover, in this case a loading mechanism and roll position detector may adopt As -U mechanism in a previous cluster rolling mill. In As -U mechanism a rotating mechanism with a eccentric ring becomes a roll loading mechanism, and a roll angle detector of a eccentric ring becomes a roll position detector.

Furthermore, the invention is characterized by having the divided support-roll system in one roll assembly of either an upper or lower roll assembly, and in the other roll assembly a regulator of plate thickness distribution in a widthwise direction. A regulator of a plate thickness distribution in a widthwise direction adopted in another roll assembly is meant a regulator for a plate crown and shape such as a roll bending force and the like. Owing to the divided support-roll mechanism as a load distribution detector for estimating a plate crown and shape, it is possible to detect and regulate precisely a plate crown and shape without delay by the regulator provided in the other roll assembly.

In the invention, as the divided support-roll system is restricted only on one side and it is unnecessary to provide a loading mechanism and roll position detector, costs can be significantly reduced while maintaining a particular function for a plate crown and shape.

Furthermore, the invention is characterized by providing the divided support-roll system in either the upper or lower roll assembly, which has an independent loading mechanism and roll position detector for all support-rolls, or excepting one to two in an axiswise direction.

According to the restriction, costs can be reduced and owing to an independent loading mechanism and roll position detector for each divided support-roll, it is possible to regulate a complex pattern profile of crown and shape in a widthwise direction.

When the other roll assembly without the divided support-roll system has a loading mechanism, a loading function or leveling function for the divided support-roll side are not necessary, and in this case one or two of the loading mechanisms and roll position detector in an axiswise direction can be eliminated.

Besides, the invention is characterized by providing hydraulic power drive system for at least one upper and lower roll assembly with the divided support-roll system. Owing to hydraulic power drive system it is possible to regulate a plate crown and shape with good responsibility and precisely even for high frequency disturbances.

EXAMPLES

An embodiment of the invention will be described in detail below.

Example 1

It is considered to apply the example having divided support-roll in both upper and lower sides as shown in FIG. 3. The example has a work-roll diameter of 450 mm, a drum length of 1750 mm and divided support-roll diameter of 400 mm, and the arrangement of a divided support-roll in an axiswise direction has seven partitions as shown in FIG. 4(*b*). The drum length of each divided support-roll is 250 mm. Each upper divided support-roll 2(2A–2C), 3(3A–3D), 4(4A–4C) is provided independently at housing 12 through load detector 5, 6, 7 (actually these accords with each divided support-roll and detailed references are abbreviated, and in load equipment is the same below) and hydraulic power equipment. It also has a mechanism that can be regulated independently by hydraulic power equipment. Divided support-rolls 2A, 2B, 2C; 3A, 3B, 3C, 3D; and 4A, 4B, 4C may each be conveniently referred to as a shortbarrel support-roll.

Moreover, divided support-rolls of the lower side 2', 3', 4' have the same mechanisms as the upper divided support-rolls previously mentioned, and can regulate a load independently. Further, in the case of hydraulic power mechanism as a load mechanism, even though an exclusive load cell is not used as a load detector, a method to calculate a load by means of measured data by hydraulic power in an oil cylinder may be adopted for estimating the load by multiplying the cylinder area. Moreover, in hydraulic power equipment 8–10, 8'–10', each position detector with an oil ram is provided as a rolling position detector.

According to use of the rolling mill as above, it is possible to measure load distribution operating between the upper work-roll 1 and the upper divided support-roll 2A–2C, 3A–3D, 4A–4C, and between the lower work-roll 1' and the lower divided support-roll 2A'–2C', 3A'–3D', 4A'–4C' respectively. Also from this data it is possible to estimate a roll load distribution operating between the rolled material 13 and the work-rolls 1, 1'. Furthermore, it is also possible to estimate plate thickness distribution in a widthwise direction of the rolled material 13. According to the estimated data it is possible to regulate the roll position of the divided support-roll immediately so that it is possible to obtain desired thickness distribution and plate shape.

Example 2

The other example of the invention is shown in FIG. 6. In the example the upper roll assembly is a type of divided support-roll that has an independent load detector characterized by the invention, and a lower roll assembly has the same mechanism as a conventional four high rolling mill.

It has increase roll bending 14, 15 and decrease roll bending equipment 16, 17 to regulate the bend of the lower work-roll 1'. The dimensions and arrangement of the upper roll assembly is the same as example 1 with lower work-roll diameter of 550 mm, and a lower support-roll diameter of 1200 mm. The roll bending equipment of the lower work-roll has a load capacity up to 90 tonf/chock. Moreover, in the rolling mill of the example, which provides a load cell 18, hydraulic power equipment 19 in the lower roll, all actuators for the plate thickness, a plate crown and shape regulators are provided on the side of a lower roll.

The load cell 18 is not indispensable equipment, but it is preferably provided as substitute equipment in the event of damage to the chock or load cell in the upper roll system, and because the divided support-roll can be reduced by half, and because the load equipment of the divided support-roll, as in example 1, is not necessary, significant equipment costs can be saved due to such structure.

Similar to example 1, it is possible to measure a load distribution operating between an upper work-roll 1 and each divided support-roll 2–4, and subsequently, the method of the invention enables a rolling load distribution operating between the rolled material 13 and the work-roll 1 to be estimated.

According to the estimation, the calculation is performed for bending the upper and lower work-rolls, flatness deformation, and plate thickness distribution in a widthwise direction of the rolled material 13 after rolling. Furthermore, according to the data a desired plate thickness and shape distribution can be realized so as to regulate, precisely and quickly, the roll bending force of a lower work-roll.

Example 3

Figure 9:
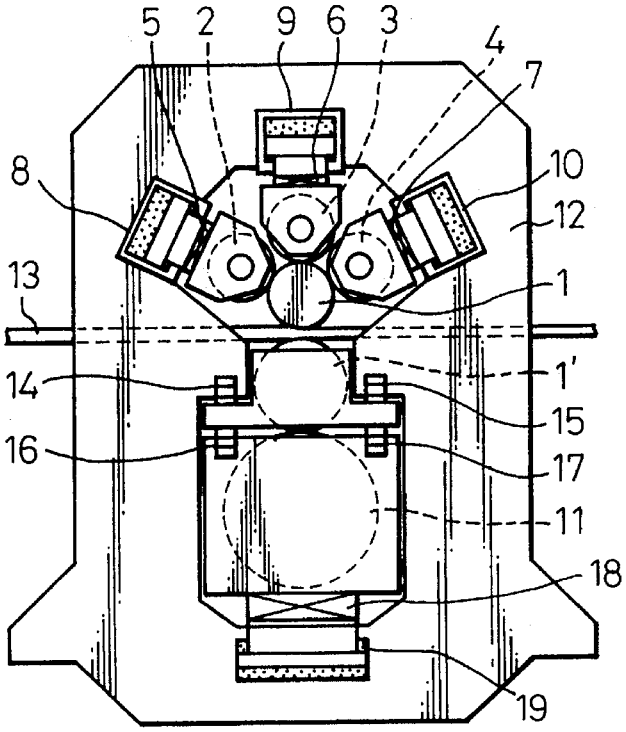
FIG. 9 is a side view illustrating the third example of the invention.

The third example of the invention is shown in FIG. 9. In the example, the upper roll assembly has the same structure as example 1, in which the lower roll assembly has the same structure as a conventional four high rolling mill having the same diameter and structure as example 2. In this example, similar to example 2, roll bending equipment 14, 15, 16, 17, a load cell 18, and hydraulic power equipment are provided.

Though these actuators and detectors of the lower roll system are not indispensable constitutions for the invention, it is preferable to provide this equipment to surplus the regulation capacity for a plate crown and shape, roll gap regulation region, adjusted capacity of a rolling path line, and in the event of a problem occurring in a load cell.

As due to such structure the divided support-roll and loading equipment that is required 20 sets in Example 1 can be reduced by half, plant costs can be saved. Similar to example 1, it is possible to measure load distribution operating between an upper work-roll 1 and each roll of a divided support-roll 2–4. From this data using a previously mentioned method, it is possible to estimate a loading distribution operating between a rolled material 13 and a work-roll 1.

Further, according to the estimated value, a roll bend and roll flatness deformation of the upper and lower work-rolls can be calculated. Thereby, it becomes possible to estimate a plate thickness distribution of a rolled material in a widthwise direction 13 after rolling. Moreover, according to the estimation, the loading position of the divided support-roll can be regulated precisely and quickly so that a desired plate thickness distribution and a plate shape can be obtained.

Example 4

Figure 10:
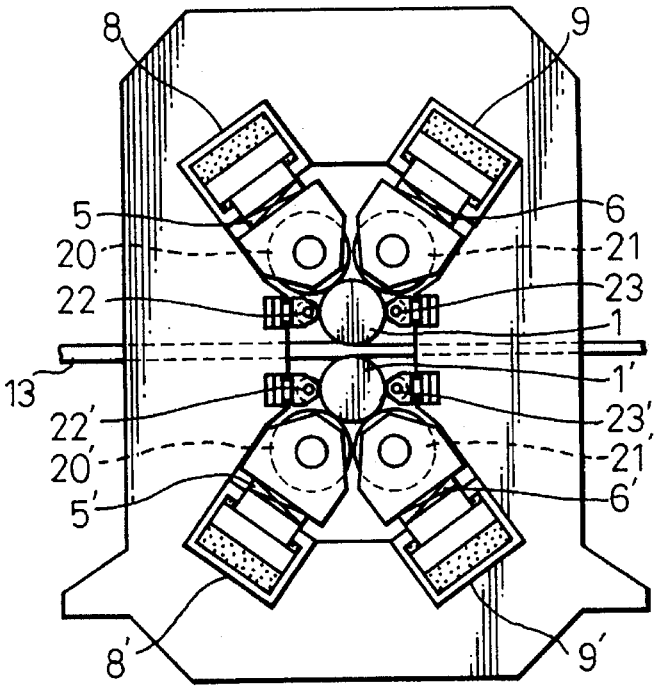
FIG. 10 is a side view illustrating the fourth example of the invention.

The fourth example of the invention is shown in FIG. 10. The work-roll has a diameter of 800 mm, a drum length of 2100 mm, and two kinds of divided support-rolls in which 20, 21, 20', 21' have diameters of 1000 mm provided in the upper and lower portion, and 22, 23, 22', 23' have diameters of 300 mm horizontally supporting the work roll. These divided support-rolls are arranged with seven partitions in an axiswise direction, as shown in a plan view in FIG. 11.

For example, it provides a mechanism such that a component force in a horizontal direction, which is loaded with a work-roll having a large diameter divided support-roll 20 (20A–20C), is compensated by a small diameter divided support-roll (23A–23C). Accordingly, as shown in FIG. 11, a large diameter divided support-roll 20 confronts a small diameter divided support-roll 23, and a large diameter divided support-roll 21 confronts a small diameter divided support-roll 22.

Figure 11A:
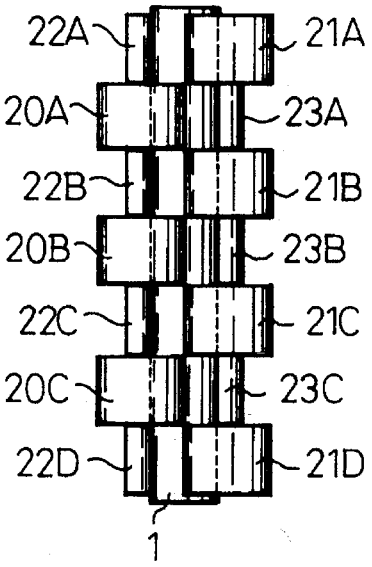
FIG. 11 is a plan view illustrating the fourth example of the invention.
Figure 11B:
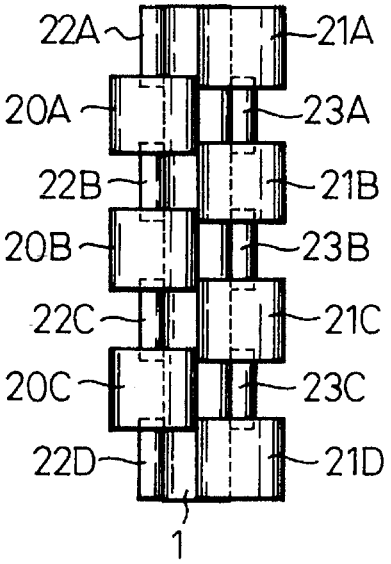

FIG. 11(*a*) is an arrangement in which each divided support-roll 20, 23 cannot interfere with numeral 21, 22 in an axiswise direction, and it may be arranged so as to overlap each other, as shown in FIG. 11(*b*), when a roll mark of the work-roll, in the vicinity of a drum of a divided support-roll, comes into question, preferably as shown in FIG. 11(*b*).

In this example the angle that is between a co-normal line of the large diameter divided support-roll 20, 21 and a work-roll 1 and a perpendicular line is 30 degrees. In this case, in order to contradict a horizontal shear stress operating on the work-roll, a force by which the small diameter divided support-roll 22, 23 should exert upon the work-roll is half of the load exerted upon the large diameter divided support-roll.

Accordingly, it is preferable to always regulate so that the exerting force of the small diameter divided support-roll becomes half of the load exerted upon a large diameter divided support-roll. Since all of the divided support-rolls of the example, provide a load detector, hydraulic power mechanism and a roll position detector, it is easy to regulate such a load.

In the example jointly using bending equipment (but not described) for the work-roll with the divided support-roll, the large diameter work-roll maintains a sufficient capability to regulate a plate crown and shape. Due to the above construction of the rolling mill, it is possible to provide the large diameter divided support-roll 20, 21, which is engaged directly to the rolling load and becomes larger than the work-roll. Therefore it is possible to design same so as to endure a large rolling load and maintain the same functions as example 1.

Example 5

Figure 12:
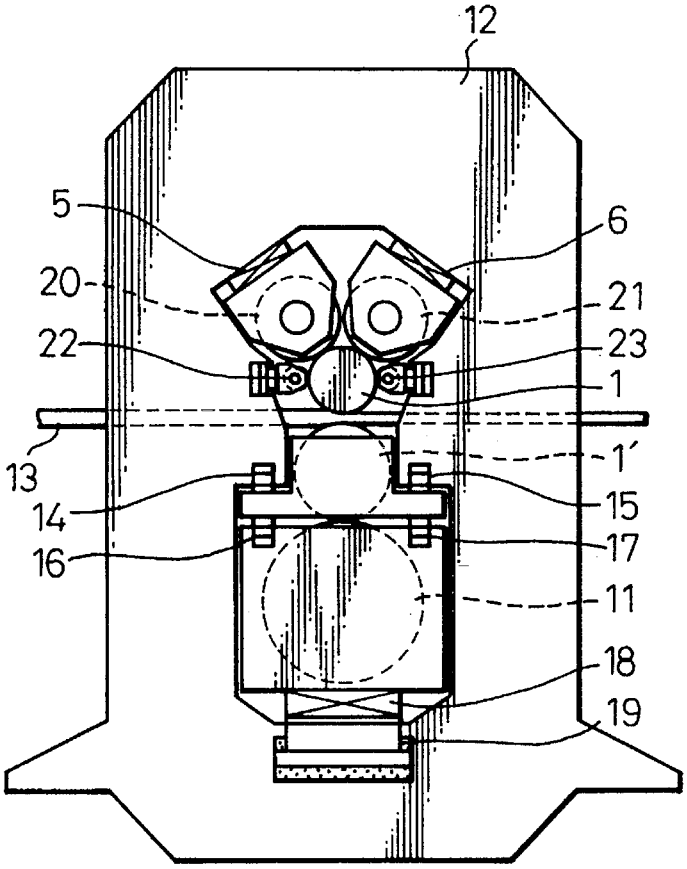
FIG. 12 is a side view illustrating the fifth example of the invention.

The fifth example of a rolling mill of the invention is shown in FIG. 12. In this example, a fundamental type roll assembly is the same as example 4, but a divided support-roll 20, 21 does not have hydraulic power mechanism and a roll position detector. And in this case, as in example 2, it is the same as a conventional four high rolling mill. The actuator for regulation of a plate crown and shape is roll bending equipment 14, 15, 16 and 17 of a lower roll, and the actuator for regulation of plate thickness is hydraulic power equipment 19 of a lower roll.

Owing to such a constitution plant costs are reduced significantly, compared to example 4. Due to the above constitution of a rolling mill it becomes possible to produce a large diameter divided support-roll 20, 21 that is engaged directly to a rolling load, and is larger than a work-roll 1. Therefore it is possible to design same so as to endure a large rolling load and maintain the same functions as example 2.

Example 6

Figure 13:
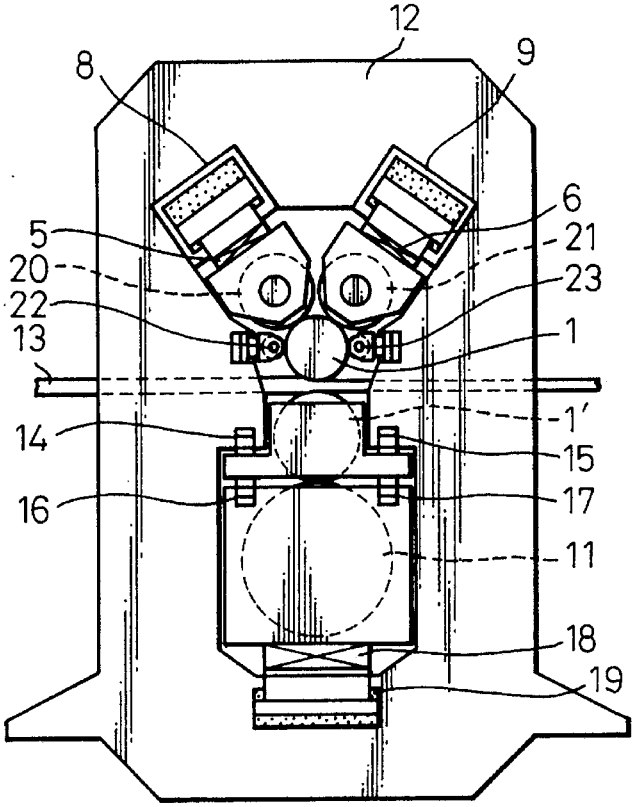
FIG. 13 is a side view illustrating the sixth example of the invention.

The sixth example of the invention is shown in FIG. 13. In this example an upper roll assembly is the same as example 4, but a lower roll assembly has the same as a conventional four high rolling mill, as in example 5. In this example, since the upper roll assembly has independent hydraulic power equipment and roll position detector, it is possible to regulate a complex profile of a plate crown and shape in a widthwise direction. And owing to such a construction, plant costs are reduced significantly compared to example 4.

Due to the above construction of a rolling mill it is possible to provide a large diameter divided support-roll 20, 21 that is engaged directly to a rolling load and larger compared to the work-roll 1. Therefore it is possible to design a construction that endures a large rolling load maintaining the same functions as example 3.

Example 7

Figure 14:
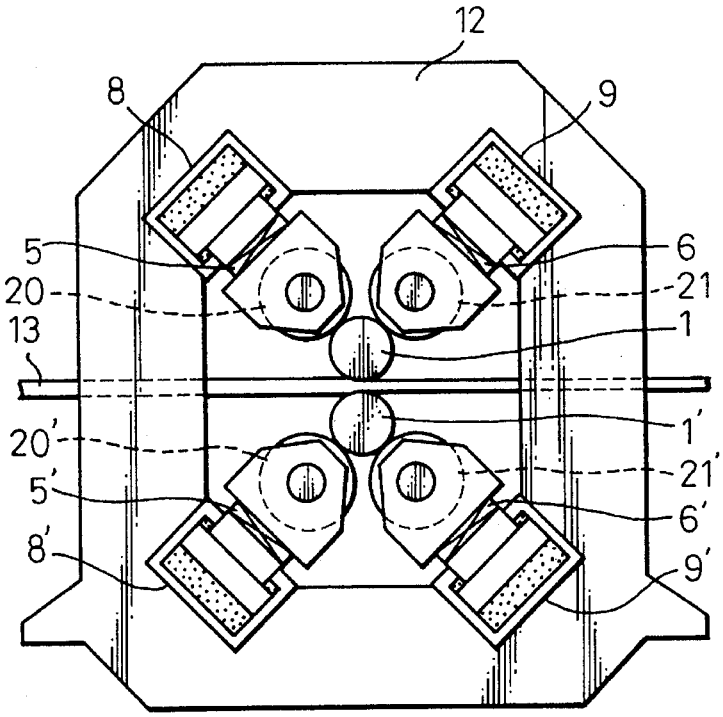
FIG. 14 is a side view illustrating the seventh example of the invention.
Figure 15A:
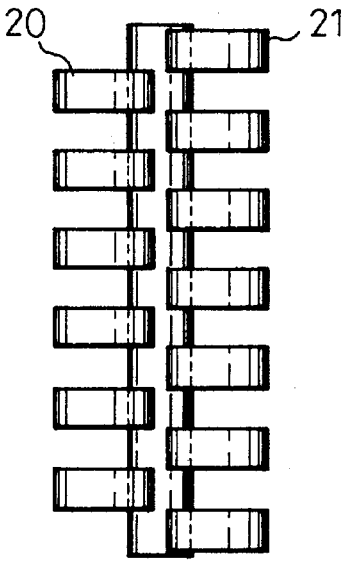
FIG. 15 is a plan view illustrating the seventh example of the invention.
Figure 15B:
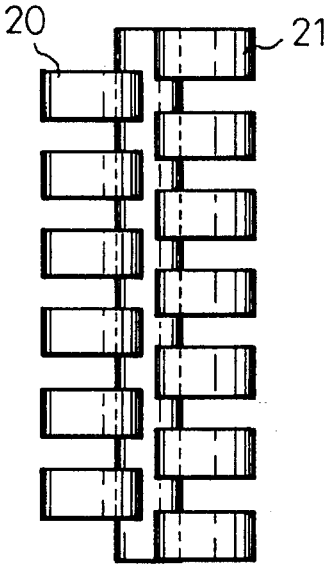

The seventh example of the invention is shown in FIG. 14. The work-roll has the diameter of 1000 mm, a drum length of 5000 mm, and the divided support-roll 20, 21 has a diameter of 1200 mm, with thirteen partitions in an axiswise direction shown in a plan view of FIG. 15. FIG. 15(*a*) is an arrangement in which each divided support-roll 20, 21 cannot interfere in an axiswise direction, and it may be arranged so as to overlap each other, as shown in FIG. 15(*b*). When a roll mark on the work-roll in the vicinity of a divided-support drum comes into question, it is preferable to adopt FIG. 15 (*b*) type.

In this example, which does not have a small diameter divided support-roll that contradicts a horizontal shear stress operating to the work-roll by the divided support-roll as example 4, because it is realized to be sufficiently large by a diameter of the work-roll for roll duration compared to the horizontal shear stress.

The example is for a plate rolling mill with an enormously long roll drum, and in order to perform more wider capability_to widthwise direction so that partition numbers increase much more. However, since it is not necessary a small diameter divided support-roll as example 4, the number of divided rolls is limitted up to 26 sets summed up of upper and lower, therefore it has good cost-performance. In the example by jointly using bending equipments (but not described) of the work-roll with the divided support-roll, because the example of a large diameter work-roll has sufficient capability to regulate a plate crown and shape.

Example 8

Figure 16:
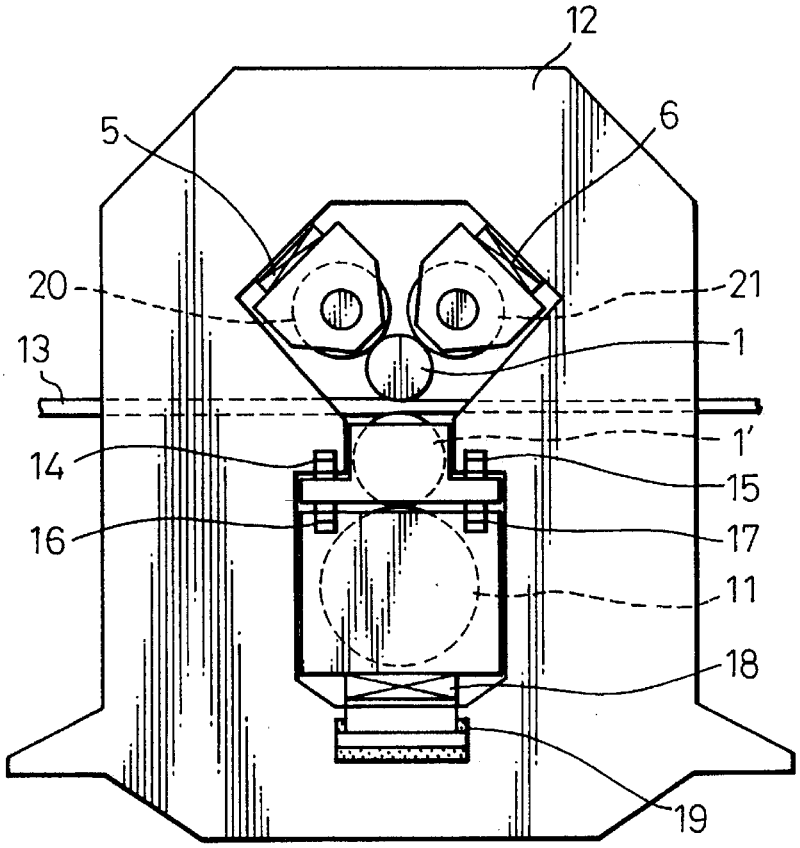
FIG. 16 is a side view illustrating the eighth example of the invention.

The eighth example of the invention is shown in FIG. 16. In this example a fundamental type roll assembly is the same as example 7, but a divided support-roll does not have hydraulic power mechanism and a roll position detector, and this lower roll assembly is the same as a conventional four high rolling mill as example 2. And in this case, as in example 2, the actuator for regulation of a plate crown and shape is roll bending equipment 14, 15, 16, and 17 of a lower roll, and the actuator for the regulation of plate thickness is hydraulic power equipment 19 of a lower roll. Such a construction lowers the plant costs significantly, compared to example 7.

Example 9

Figure 17:
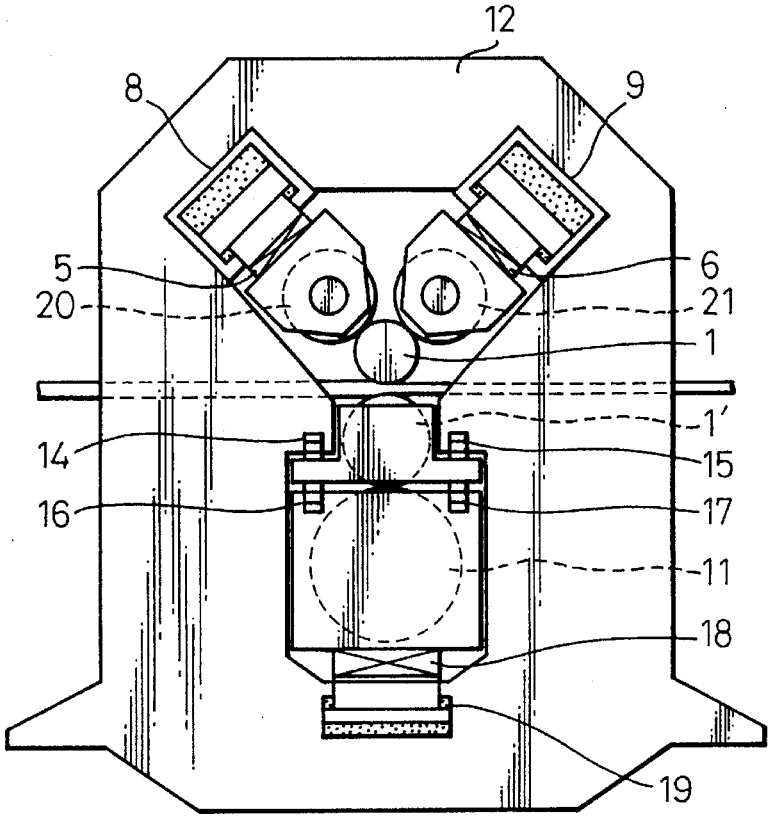
FIG. 17 is a side view illustrating the ninth example of the invention.

The ninth example of the invention is shown in FIG. 17. In this example, an upper roll assembly is the same as example 7, and in this lower roll assembly, as in example 8, it is the same as a conventional four high rolling mill. Such a construction lowers plant costs significantly, compared to example 7. Since the upper roll assembly provides an independent hydraulic power mechanism and roll position detector, it is possible to regulate a complex profile in a widthwise direction of a plate crown and shape.

Example 10

Figure 18:
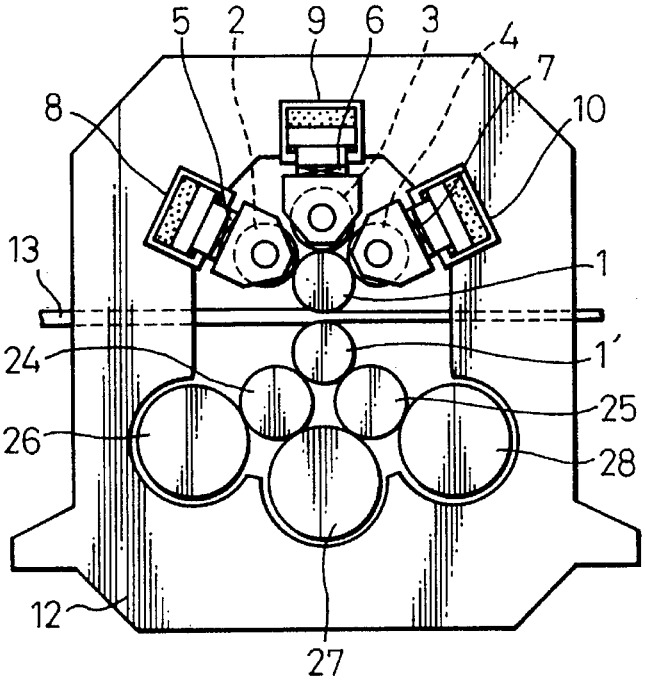
FIG. 18 is a side view illustrating the tenth example of the invention.

The tenth example of the invention is shown in FIG. 18. In this example, an upper roll assembly type is such that the upper roll assembly has an independent load detector, hydraulic power equipment, and a roll position detector characterized in the invention, and this lower roll assembly is the same as a twelve high rolling mill, which has a divided support-roll provided as known As -U mechanism.

Also due to the combination it is possible to regulate for desired profile value from a plate crown detected by the upper roll assembly without delay and to regulate complicated profile in widthwise of a plate crown and shape.

In the example, preferably, As -U mechanism is used at the setting of initial roll gap before rolling, and thereafter for regulation of optimum conditions during rolling, hydraulic power mechanism having good responsiblity of an upper roll assembly is used. Without problem in response of a regulation for a plate crown during rolling, it may be abbreviate hydraulic power equipment of upper roll assembly and roll position detector as example 2.

Example 11

Figure 19:
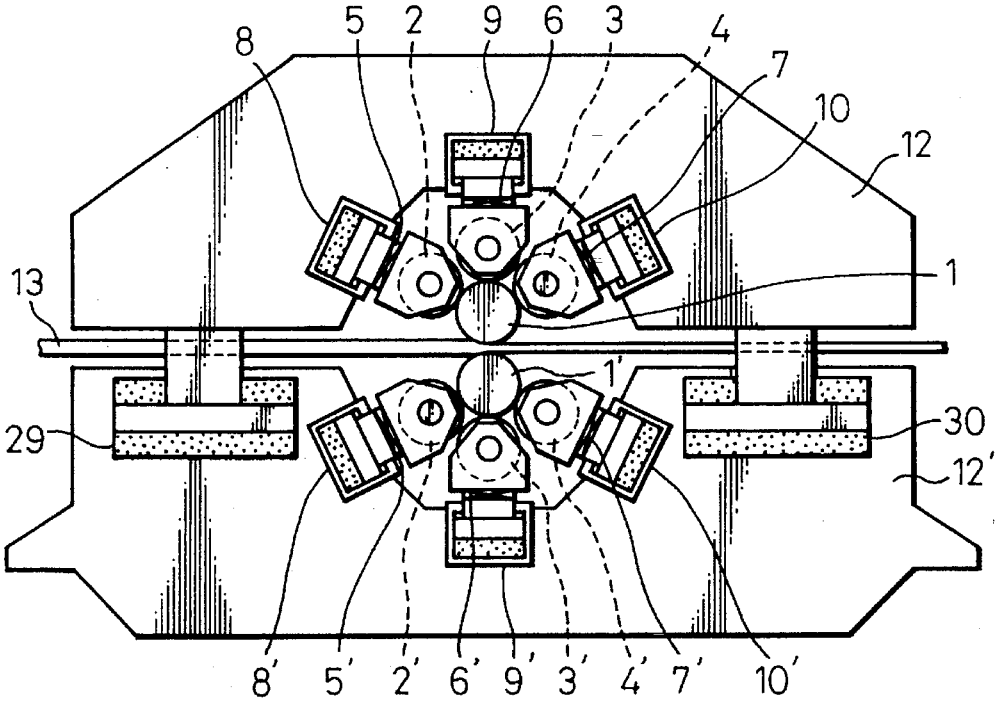
FIG. 19 is a side view illustrating the eleventh example of the invention.

It is considered to apply the example having divided support-roll in both upper and lower sides as shown in FIG. 19. The work roll has a diameter of 450 mm, a drum length of 1750 mm, and the divided support-roll has a diameter of 450 mm, seven partitions divided in a widthwise direction, and a drum length of 250 mm. Each upper divided support-roll 2(2A–2C), 3(3A–3D), (4A–4C) is fixed independently of each other at a housing 12 through a load detector 5, 6, 7 (actually provided in accordance with each divided support-roll, and abbreviated detail symbols are the same as the loading equipment) and hydraulic power equipment 8, 9, 10.

It has a mechanism such that it can regulate independently using the hydraulic power equipment. Further the lower divided support-roll sides 2', 3' and 4' are constituted in the same way, and can regulate a load independently of each other. Further, in the case of applying the hydraulic power mechanism as a loading mechanism, even though an exclusive load cell as a load detector is not used, a method to calculate a load by means of measured data by hydraulic power in the cylinder may be adopted for estimating the load by multiplying the cylinder area. More, in hydraulic power equipment 8–10, 8'–10', each position detector having an oil ram is provided as a roll position detector.

According to a rolling mill with a construction as above, it is possible to measure load distribution operating between the upper work-roll 1 and the upper divided support-roll 2A–2C, 3A–3D, 4A–4C, and between the lower work-roll 1' and the lower divided support-roll 2A'–2C', 3A'–3D', 4A'–4C' by the above mentioned method so that an estimation of a load distribution operating between the rolled material 13 and the work-roll 1, 1' can be performed.

Furthermore from these data, plate thickness distribution in a widthwise direction of a rolled material 13 after roll can be obtained. Moreover, according to these estimated data, it is possible to regulate the roll position of the divided support-roll with a high degree of precision and speed so that it is possible to obtain a desired thickness distribution and plate shape.

In the example, the hydraulic power mechanism 29, 30 is provided. When plate thickness changes throughout the whole plate, the hydraulic power mechanism can function as bearing parts that are used as a load mechanism for each divided support-roll so as to regulate plate crown and shape. Consequently, a transfer range can be restricted in a small region so that a thrust force operating the load mechanism of each divided support-roll becomes sufficiently small.

Example 12

Figure 20:
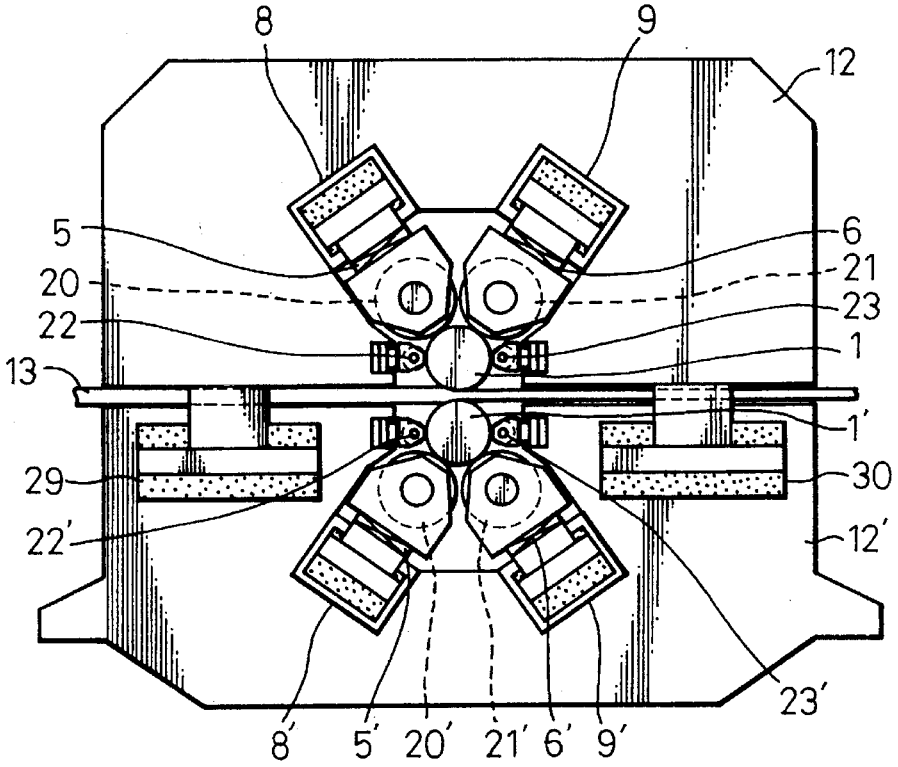
FIG. 20 is a side view illustrating the twelfth example of the invention.

The example of the invention is shown in FIG. 20. The work roll has a diameter of 800 mm, a drum length of 2100 mm, and two kinds of divided support-rolls in which numeral 20, 21, 20', 21' have diameter of 1000 mm provided in the upper and lower portion and 22, 23, 22', 23' have a diameter of 300 mm supporting the work roll horizontally. These divided support-rolls are arranged so as to have seven partitions in an axiswise direction as shown in a plan view in FIG. 11.

For example, it provides a mechanism such that a component force in a horizontal direction, which is loaded on the work roll by the large diameter divided support-roll 20 (20A–20C) is compensated through the small diameter divided support-roll 23 (23A–23C). Accordingly, the large diameter divided support-roll 20 confronts the small diameter divided support-roll 23, and the large diameter divided support-roll 21 confronts the small diameter divided support-roll 22.

It is an arrangement in which each divided support-roll 20, 23 cannot interfere with numeral 21, 22 in an axiswise direction so that it may be arranged so as to overlap with each other when a roll mark of the work-roll in the vicinity of a drum of the divided support-roll comes into question, preferably overlapping each other.

In this example the angle is 30 degrees between a conormal line in the large diameter divided support-roll 20, 21 and the work-roll 1, and a perpendicular line. In this case, in order to counter the horizontal shear stress operating on the work-roll, the force by which the small diameter divided support-roll 22, 23 should act against the work-roll is half of the load exerted by the large diameter divided support-roll.

Accordingly, it is preferable to regulate the load by pushing the small diameter divided support-roll with half the load of a large diameter divided support-roll. Since all divided support-rolls of the example provide a load detector, hydraulic power mechanism and a roll position detector, it is easy to regulate such a loading.

In the example, by jointly using work-roll bending equipment (not designated) with a divided support-roll, a large diameter work-roll such as the example can sufficiently regulate plate crown and shape. Due to the above constitution of the rolling mill it is possible to make the large diameter divided support-roll 20, 21 that is engaged directly to a roll load larger than the work-roll. Therefore it is possible to design same so as to endure a large roll load as in example 11.

Example 13

Figure 21:
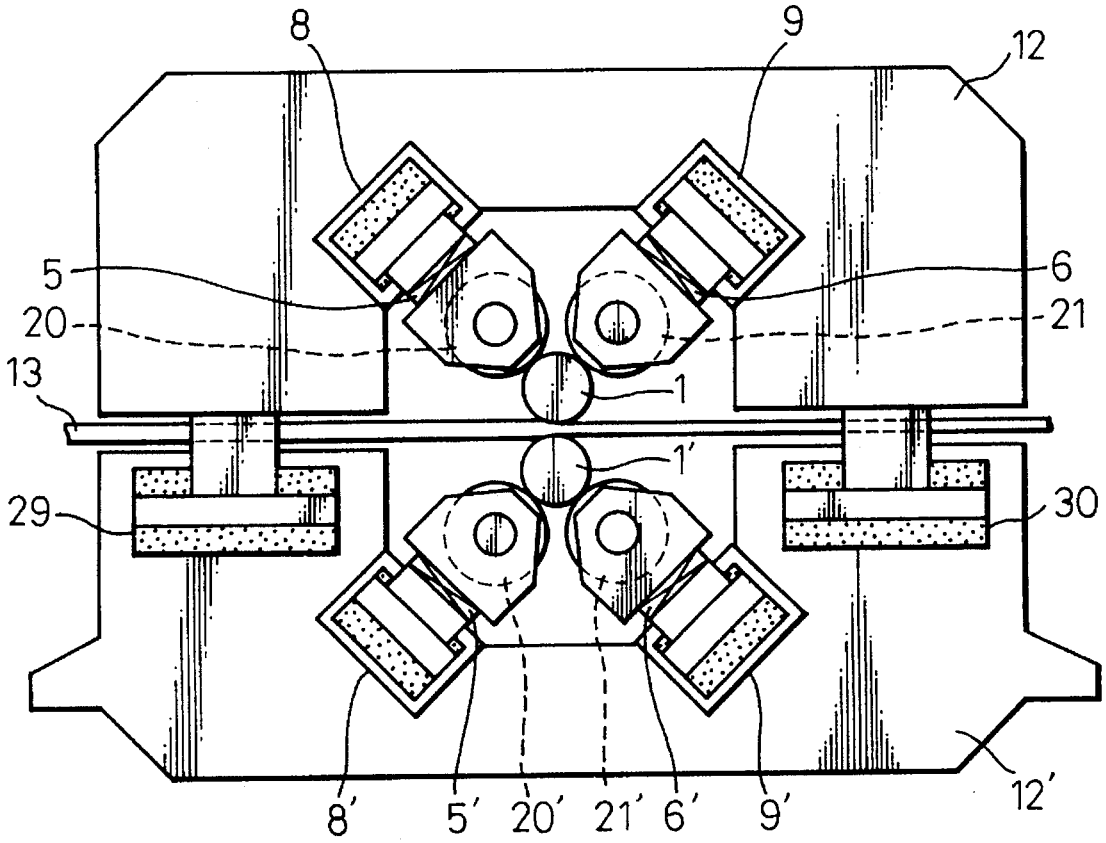
FIG. 21 is a side view illustrating the thirteenth example of the invention.

The example of the invention is shown in FIG. 21. The work roll has a diameter of 1000 mm, a drum length of 5000 mm, and the divided support-roll 20, 21 has a diameter 1200 mm, with thirteen partitions in an axiswise direction as shown in a plan view of FIG. 15. It is an arrangement in which each divided support-roll 20, 21 cannot interfere in an axiswise direction so that they may overlap each other and when a roll mark of a work-roll in the vicinity of a drum of a divided support-roll comes into question, they preferably overlap each other.

In this example, without a small diameter divided support-roll that counters the horizontal shear stress operating on the work-roll by the divided support-roll, as in example 12, because it is realized to be sufficiently large for a diameter of a work-roll for roll duration compared to a horizontal shear stress.

The example is a thick plate rolling mill with an enormously long roll drum, and in order to perform wider capability to widthwise direction, so that partition numbers increases much more. However, since it is not necessary a small diameter divided support-roll as example 12, the number of divided rolls is limitted up to 26 sets summed up of upper and lower, therefore it has good cost-performance. In the example, by jointly using bending equipments (but not described) of the work-roll with a divided support-roll, because a large diameter work-roll can sufficiently regulate a plate crown and shape.

In the example, moreover, it provides hydraulic power mechanism 29, 30. When a plate thickness is changed through the whole plate, the hydraulic power mechanism can function to bear parts that are used as a load mechanism of each divided support-roll for regulation of plate crown and shape. Consequently, a transfer range of the divided support-roll can be restricted to small region so that a thrust force operating as a load mechanism of each divided support-roll becomes sufficiently small.

In the above examples, the roll assembly and housing of the invention have been described in detail.

Next the point of which the work-roll and divided support-roll are relatively possible to move will be described below.

In the invention the work-roll 1 and 1' are made to move selectively in an axiswise direction. Mainly in hot roll the work-roll is made to move during idle time so that it makes contact with each divided support-roll and the work-roll changes periodically, thereby suitably preventing roll mark and local abrasion of the roll.

In cold roll, specifically, perfect continuous rolling, the work-roll is moved continuously as well during rolling, and thereby contact between each divided support-roll and work-roll changes continuously so that roll mark and local abrasion of the roll can be prevented. Moreover the work roll is not always moved but the divided support-roll may be moved.

Industrial Applicability

Owing to the rolling mill of the invention, the plate crown and shape during roll can be detected and regulated precisely without delay. Moreover, in accordance with the improvement of regulation precision for the plate crown and shape, an automatic roll operation can be performed. Accordingly, the invention can provide a rolling mill that effectively produce a high quality flat product.

EXPLANATION OF REFERENCES

1, 1' . . . work-roll
2–4, 20'–23' . . . upper divided support-roll
2'–4', 20'–23' . . . lower divided support-roll
5–7 . . . load detector equipment of upper divided support roll
5'–7' . . . load detector equipment of lower divided support roll
8–10 . . . loading mechanism of upper divided support-roll
11 . . . support-roll of one body type
12, 12' . . . roll mill housing
13 . . . rolled material
14, 15 . . . increase roll bending equipment
16, 17 . . . decrease roll bending equipment
18 . . . load cell
19 . . . hydraulic power loading mechanism
24, 25 . . . intermediate roll
26, 27, 28 . . . divided support-roll of a twelve high roll mill in a prior art
29, 30 . . . distance adjusting equipment between upper and lower roll assemblies

We claim:

1. A rolling mill for rolling a rolled flat product including a pair of work-rolls confronted reciprocally and a set of support rolls for directly supporting rolling force mounted for rotation on a periphery of at least one of said work-rolls, comprises a roll assembly in at least either an upper or lower side having a structure in which said one work-roll is supported by said set of support rolls; said set of support rolls comprises not less than two support-rolls each of which is divided into not less than three short-barrel support-rolls in a roll axiswise direction, and each divided short-barrel support-roll is provided, independently, with load detector equipment, said one work-roll having a roll axiswise distribution of rolling force acting between the rolled flat product and said one work-roll when said rolling mill is rolling said rolled flat product, and said rolling mill has a device for calculating the roll axiswise distribution of the rolling force acting between the rolled flat product and said one work-roll only using measured force acting between each short-barrel support-roll and said one work-roll when said rolling mill is rolling said rolled flat product measured with said load detector equipment independently provided to each short-barrel support-roll and for immediately regulating said short-barrel support rolls in response to said calculated roll axiswise distribution.

2. A rolling mill according to claim 1, wherein a bearing mechanism of said divided support-roll is provided with a type of a roller follower bearing in a roll drum portion.

3. A rolling mill according to claim 1, wherein said flat products include a rolled product having a width, and wherein said roll assembly in only one of either an upper or lower side is provided with said divided support-rolls, and the other side is provided with regulating equipment for thickness distribution of said flat products after rolling along a direction perpendicular to the rolling direction.

4. A rolling mill according to claim 1, wherein said roll assembly in only one of either an upper or lower side is provided with said divided support-rolls, and wherein all of said divided support-rolls, or excepting one to two, are provided, independently, with loading mechanisms and roll position detectors.

5. A rolling mill according to claim 1, wherein said one work-roll and said divided support-rolls are mounted for movement relatively in a roll axiswise direction.

6. A rolling mill according to claim 2, wherein said work-roll and said divided support-rolls are mounted for movement relatively in a roll axiswise direction.

7. A rolling mill according to claim 1, wherein said roll assembly in only one of either an upper or lower side is provided with said divided support-rolls, wherein all of said divided support rolls, or excepting one to two, are provided, independently, with loading mechanisms and roll position detectors, and said loading mechanisms are driven by hydraulic power system.

8. A rolling mill for rolling a rolled flat product including a pair of work-rolls confronted reciprocally and a set of support-rolls for directly supporting rolling force mounted for rotation on a periphery of each of said work-rolls, comprises a roll assembly in both an upper and lower side having a structure in which one work-roll is supported by one support-roll set, said support roll set comprises not less than two support-rolls each of which is divided into not less than three short-barrel support-rolls in a roll axiswise direction, for at least one of either assembly in the upper and lower sides, each divided short-barrel support-roll is provided, independently, with load detector equipment, a loading mechanism and a roll position detector, said one work-roll having a roll axiswise distribution of rolling force acting between the rolled flat product and said one work-roll when said rolling mill is rolling said rolled flat product, and said rolling mill has a device for calculating the roll axiswise distribution of the rolling force acting between the rolled flat product and said one work-roll only using measured force acting between each short-barrel support-roll and said one work-roll when said rolling mill is rolling said rolled flat product measured with said load detector equipment independently provided to each short-barrel support-roll and for immediately regulating said short-barrel support rolls in response to said calculated roll axiswise distribution.

9. A rolling mill according to claim 8, wherein a loading mechanism of said divided support-roll of said roll assembly in at least one of either an upper or lower side is driven by a hydraulic power system.

10. A rolling mill according to claim 8, wherein a distance between the roll assemblies in the upper lower sides is adjustable.

* * * * *